US011839947B2

(12) United States Patent
Kamiki et al.

(10) Patent No.: US 11,839,947 B2
(45) Date of Patent: Dec. 12, 2023

(54) PAD-TEMPERATURE REGULATING APPARATUS, AND POLISHING APPARATUS

(71) Applicant: EBARA CORPORATION, Tokyo (JP)

(72) Inventors: Keisuke Kamiki, Tokyo (JP); Toru Maruyama, Tokyo (JP); Yasuyuki Motoshima, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/692,038

(22) Filed: Mar. 10, 2022

(65) Prior Publication Data

US 2022/0305617 A1 Sep. 29, 2022

(30) Foreign Application Priority Data

Mar. 25, 2021 (JP) ..... 2021-051874

(51) Int. Cl.

| | |
|---|---|
| ***B24B 55/02*** | (2006.01) |
| ***B24B 37/34*** | (2012.01) |
| ***B24B 37/015*** | (2012.01) |
| ***B24B 37/04*** | (2012.01) |

(52) U.S. Cl.

CPC ..... *B24B 55/02* (2013.01); *B24B 37/015* (2013.01); *B24B 37/04* (2013.01); *B24B 37/34* (2013.01)

(58) Field of Classification Search

CPC ..... B24B 37/015; B24B 37/34; B24B 37/04; B24B 37/07; B24B 37/10; B24B 55/02; B24B 41/007; B24B 7/228

USPC ..... 451/444, 449, 488, 53

See application file for complete search history.

(56) References Cited

U.S. PATENT DOCUMENTS

| | | | | |
|---|---|---|---|---|
| 9,475,167 | B2 | 10/2016 | Maruyama et al. | |
| 9,782,870 | B2 | 10/2017 | Maruyama et al. | |
| 10,099,340 | B2 | 10/2018 | Motoshima | |
| 2008/0311823 | A1* | 12/2008 | Aiyoshizawa | B24B 55/02 451/7 |
| 2011/0159782 | A1 | 6/2011 | Sone et al. | |

(Continued)

FOREIGN PATENT DOCUMENTS

| | | | | |
|---|---|---|---|---|
| JP | 2000295908 A | * | 10/2000 | A01C 11/02 |
| JP | 2017-148933 | | 8/2017 | |
| TW | 201731632 A | * | 9/2017 | B24B 27/033 |

OTHER PUBLICATIONS

English translation of JP2000295908A (Year: 2000).*
English translation of TW201731632A (Year: 2017).*

*Primary Examiner* — Brian D Keller
*Assistant Examiner* — Sukwoo James Chang
(74) *Attorney, Agent, or Firm* — BakerHostetler

(57) ABSTRACT

A pad-temperature regulating apparatus is disclosed, which includes a heat exchanger capable of being cleaned in a limited space. A pad-temperature regulating apparatus includes a heat exchanger configured to contact a polishing pad to exchange heat with the polishing pad, a moving mechanism configured to move the heat exchanger between a temperature regulating position where the heat exchanger can exchange heat with the polishing pad, and a retreat position located on a side of the polishing pad, and a cleaning mechanism configured to clean the heat exchanger moved to the retreat position. The heat exchanger has an approximate triangular shape in a horizontal cross-section, and a longest side of the heat exchanger faces the polishing pad when the heat exchanger is moved to the retreat position.

8 Claims, 15 Drawing Sheets

(56) References Cited

U.S. PATENT DOCUMENTS

2012/0220196 A1* 8/2012 Maruyama ..... B24B 37/04
451/7
2019/0389030 A1* 12/2019 Maruyama ..... G01M 3/2807

* cited by examiner

PAD-TEMPERATURE REGULATING APPARATUS, AND POLISHING APPARATUS

CROSS REFERENCE TO RELATED APPLICATION

This document claims priority to Japanese Patent Application Number 2021-051874 filed Mar. 25, 2021, the entire contents of which are hereby incorporated by reference.

BACKGROUND

A CMP (Chemical Mechanical Polishing) apparatus is a polishing apparatus which is used in a process of polishing a surface of a substrate, such as a wafer, in the manufacturing of a semiconductor device. The CMP apparatus is configured to hold and rotate the substrate with a polishing head, and press the substrate against a polishing pad on a rotating polishing table to polish the surface of the substrate. During polishing, a polishing liquid (or slurry) is supplied onto the polishing pad, so that the surface of the substrate is planarized by the chemical action of the polishing liquid and the mechanical action of abrasive grains contained in the polishing liquid.

A polishing rate of the substrate depends not only on a polishing load on the substrate pressed against the polishing pad, but also on a surface temperature of the polishing pad. This is because the chemical action of the polishing liquid on the substrate depends on the temperature. Therefore, in the manufacturing of a semiconductor device, it is important to maintain an optimum surface temperature of the polishing pad during polishing of the substrate in order to increase the polishing rate of the substrate, and to keep the increased polishing rate constant.

From this viewpoint, a pad-temperature regulating apparatus is conventionally used to regulate a surface temperature of a polishing pad (see Japanese laid-open patent publication No. 2017-148933, for example). The pad-temperature regulating apparatus includes a heat exchanger which contacts a surface of the polishing pad and into which a heating liquid having a regulated temperature and a cooling liquid having a regulated temperature are supplied. Flow rates of the heating liquid and the cooling liquid supplied into the heat exchanger can be regulated to thereby maintain the surface temperature of the polishing pad, during polishing of the substrate, at a desired optimum temperature.

During polishing of the substrate, the heat exchanger is placed in contact with the surface of the polishing pad, and thus dirt, such as abrasive grains contained in the polishing liquid, and wear particles of the polishing pad, adheres to the surface of the heat exchanger. When the dirt falls down from the heat exchanger during polishing of the substrate, and is caught between the polishing pad and the substrate, scratches are formed on the surface of the substrate. The scratches can be a cause of defects that lower a reliability of the semiconductor devices. In other words, scratches can cause a decrease in the yield of semiconductor devices. Therefore, it is preferable to clean the heat exchanger periodically (e.g., every time the substrate is polished).

However, in a conventional polishing apparatus, the polishing pad is placed in a polishing chamber partitioned by partition walls, and in the present situation where downsizing of the apparatus is required, a footprint of the polishing chamber needs to be as small as possible. Therefore, it is difficult to secure a sufficient cleaning space for the heat exchanger beside the polishing pad.

FIG. 15A is a schematic top view showing an example of a conventional polishing apparatus, and FIG. 15B is a schematic top view showing a state where a heat exchanger shown in FIG. 15A is moved toward a partition wall. The polishing apparatus shown in FIG. 15A includes a polishing head 101 for holding and rotating a substrate (e.g., a wafer), a polishing pad 103 supported by a polishing table, and a heat exchanger 111 of a pad-temperature regulating apparatus for regulating a surface temperature of the polishing pad 103. The conventional heat exchanger 11 has a circular shape in horizontal cross-sectional view. The polishing head 101, the polishing pad 103, and the heat exchanger 111 are arranged in a polishing chamber 180 which is partitioned by a plurality of partition walls 181.

In order to downsize the polishing apparatus, the partition walls 181 need to be placed as close as possible to the polishing pad 103. However, when the partition walls are moved closer to the polishing pad 103, it becomes impossible to provide vacant space for cleaning the heat exchanger 11, which has a circular shape, in the polishing chamber 180. For example, as shown in FIG. 15(*b*), the heat exchanger 111 cannot be completely moved beside the polishing pad 103 (in other words, a part of the heat exchanger 111 is overlapped with the polishing pad 103 in the vertical direction), and as a result, a space for cleaning the heat exchanger 111 cannot be secured.

SUMMARY

Therefore, there is provided a pad-temperature regulating apparatus which has a heat exchanger capable being cleaned in a limited space. Further, there is provided a polishing apparatus including such pat-temperature regulating apparatus.

Embodiments, which will be described below, relate to a pad-temperature regulating apparatus having a heat exchanger that regulates a surface temperature of a polishing pad. Furthermore, the embodiments relates to a polishing apparatus including such pad-temperature regulating apparatus.

In an embodiment, there is provided a pad-temperature regulating apparatus for regulating a surface temperature of a polishing pad, comprising: a heat exchanger configured to contact the polishing pad to exchange heat with the polishing pad; a moving mechanism configured to move the heat exchanger between a temperature regulating position where the heat exchanger can exchange heat with the polishing pad, and a retreat position located on a side of the polishing pad; and a cleaning mechanism configured to clean the heat exchanger moved to the retreat position, wherein the heat exchanger has an approximate triangular shape in a horizontal cross-section, and a longest side of the heat exchanger faces the polishing pad when the heat exchanger is moved to the retreat position.

In an embodiment, the heat exchanger has a heating flow passage and a cooling flow passage into which a heating liquid having a regulated temperature and a cooling liquid having a regulated temperature are supplied respectively, the heating flow passage and the cooling flow passage are arranged next to each other, and extend in a spiral manner along an outer shape of the heat exchanger, an inlet of the heating flow passage and an inlet of the cooling flow passage are placed at a periphery of the heat exchanger, and an outlet of the heating flow passage and an outlet of the cooling flow passage are placed at a center of the heat exchanger.

In an embodiment, the heat exchanger has an approximately isosceles triangular shape in the horizontal cross section, which is linearly symmetrical about a line connecting a midpoint of the long side and an intersection point of rest short sides.

In an embodiment, the heat exchanger has a shape in which the midpoint of the long side projects outward from a straight line connecting both ends of the long side.

In an embodiment, the moving mechanism includes: an arm configured to hold the heat exchanger; an elevating mechanism configured to vertically move the heat exchanger through the arm; and a link mechanism which is attached to the heat exchanger, and is configured to couple the heat exchanger to the arm, wherein the link mechanism allows vertical movement of the heat exchanger relative to the arm, while restricting horizontal movement of the heat exchanger relative to the arm.

In an embodiment, the link mechanism includes: a first link arm which is coupled to the arm; a second link arm which is coupled to the arm, and is disposed on opposite side of the first link arm across the arm; a first link block attached to an upper surface of the first link arm, a second link block attached to an upper surface of the heat exchanger, and a link rod whose both ends are rotatably supported by the first link block and the second link block, and which has a link projection extending downward, and formed at an end supported by the second link block, wherein the link projection is separated from the upper surface of the second link arm when the heat exchanger is in the temperature regulating position, and the link projection, when the heat exchanger is raised by the elevating mechanism, comes into contact with the upper surface of the second link arm.

In an embodiment, the link mechanism further includes a stopper which prevents vertical movement of the heat exchanger with respect to the arm, and the stopper is placed in contact with the upper surface of the first link arm when, after the link protrusion of the second link arm contacts the upper surface of the second link arm, the heat exchange is further raised by the elevating mechanism.

In an embodiment, the cleaning mechanism includes: a cleaning tank into which a bottom surface of the heat exchanger is immersed; and an oscillating mechanism for oscillating the cleaning tank with respect to the heat exchanger.

In an embodiment, there is provided a polishing apparatus in which a substrate is brought into sliding contact with a polishing pad to thereby polish the substrate, comprising: a polishing table for supporting the polishing pad; a polishing head configured to press the substrate against the polishing pad; and a pad-temperature regulating apparatus configured to regulate a surface temperature of the polishing pad; wherein the pad-temperature regulating apparatus comprises said pad-temperature regulating apparatus.

According to the above embodiments, the heat exchanger has an approximate triangular shaped in a horizontal cross-section, so that the heat exchanger can be cleaned in a vacant space formed between the polishing pad and partition walls that divide a polishing chamber. Therefore, the heat exchanger can be cleaned in a limited space.

DESCRIPTION OF EMBODIMENTS

Embodiments will be described below with reference to the drawings.

Figure 1:
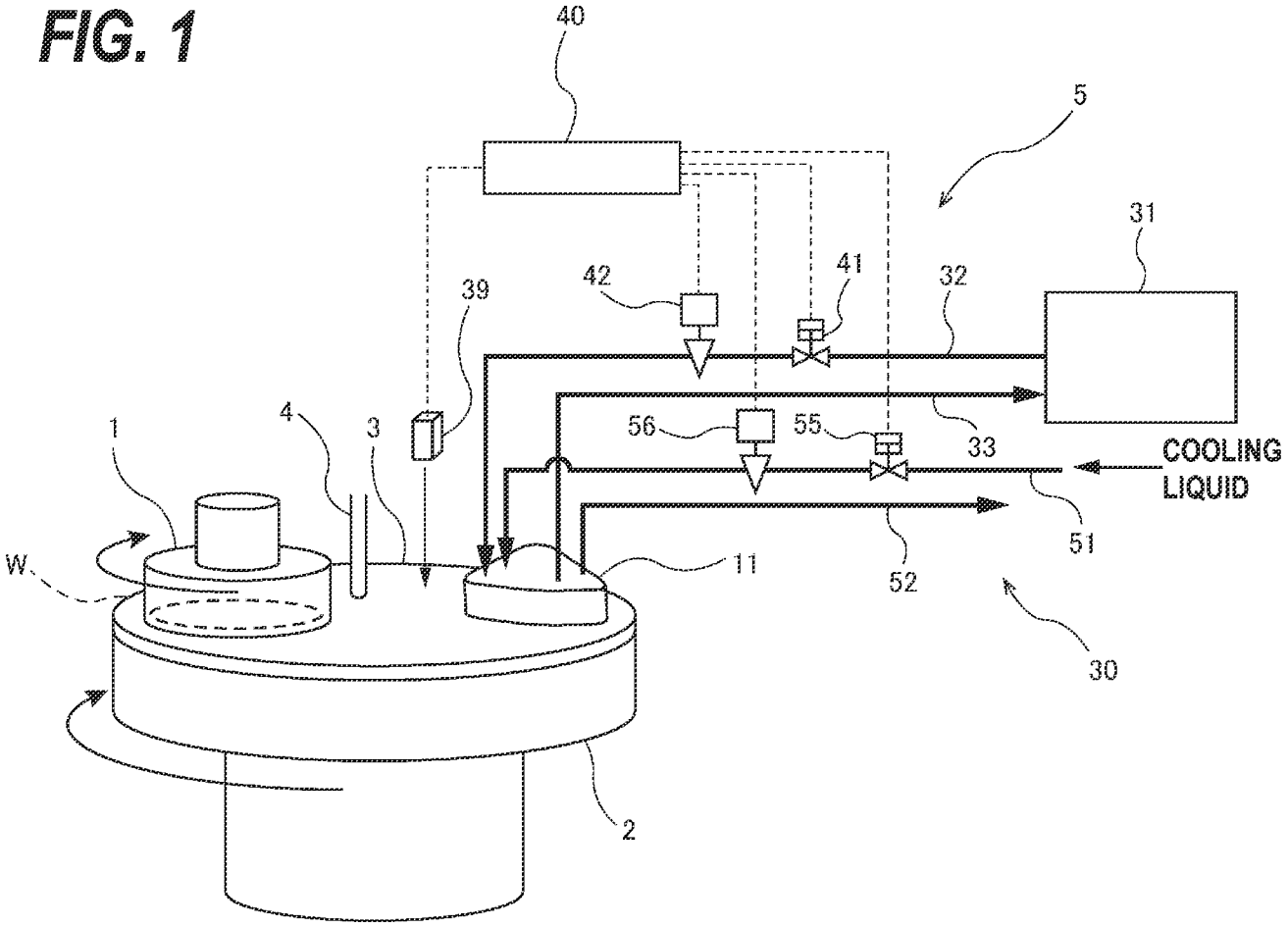
FIG. 1 is a schematic view showing a polishing apparatus according to an embodiment.

FIG. 1 is a schematic view showing a polishing apparatus according to an embodiment. The polishing apparatus shown in FIG. 1 includes a polishing head 1 for holding and rotating a wafer W which is an example of a substrate, a polishing table 2 that supports a polishing pad 3, a polishing-liquid supply nozzle 4 for supplying a polishing liquid (e.g. a slurry) onto a surface of the polishing pad 3, and a pad-temperature regulating apparatus 5 for regulating a surface temperature of the polishing pad 3. The surface (upper surface) 3*a* of the polishing pad 3 provides a polishing surface for polishing the wafer W.

The polishing head 1 is vertically movable, and is rotatable about its axis in a direction indicated by arrow. The wafer W is held on a lower surface of the polishing head 1 by, for example, vacuum suction. A motor (not shown) is coupled to the polishing table 2, so that the polishing table 2 can rotate in a direction indicated by arrow. As shown in FIG. 1, the polishing head 1 and the polishing table 2 rotate in the same direction. The polishing pad 3 is attached to the upper surface of the polishing table 2.

Polishing of the wafer W is performed in the following manner. The wafer W, to be polished, is held by the polishing head 1, and is then rotated by the polishing head 1. The polishing pad 3 is rotated together with the polishing table 2. In this state, the polishing liquid is supplied from the polishing-liquid supply nozzle 4 onto the surface of the polishing pad 3, and the surface of the wafer W is then pressed by the polishing head 1 against the surface 3*a*, i.e. the polishing surface, of the polishing pad 3. The surface of the wafer W is polished by the sliding contact with the polishing pad 3 in the presence of the polishing liquid. The surface of the wafer W is planarized by the chemical action of the polishing liquid and the mechanical action of abrasive grains contained in the polishing liquid.

As shown in FIG. 1, the pad-temperature regulating apparatus 5 includes a heat exchanger 11 which can contact the surface of the polishing pad 3, and a liquid supply system 30 for supplying a heating liquid having a regulated temperature and a cooling liquid having a regulated temperature into the heat exchanger 11. In this embodiment, the heat exchanger 11 has an approximately triangular shape as viewed in horizontal cross section. This liquid supply system 30 includes a heating-liquid supply tank 31 as a heating-liquid supply source for storing the heating liquid having a regulated temperature, and a heating-liquid supply pipe 32 and a heating-liquid return pipe 33, each coupling the heating-liquid supply tank 31 to the heat exchanger 11. One ends of the heating-liquid supply pipe 32 and the heating-liquid return pipe 33 are coupled to the heating-liquid supply tank 31, while the other ends are coupled to the heat exchanger 11.

The heating liquid having a regulated temperature is supplied from the heating-liquid supply tank 31 to the heat exchanger 11 through the heating-liquid supply pipe 32, flows in the heat exchanger 11, and is retuned from the heat exchanger 11 to the heating-liquid supply tank 31 through the heating-liquid return pipe 33. In this manner, the heating liquid circulates between the heating-liquid supply tank 31 and the heat exchanger 11. The heating-liquid supply tank 31 has a heater (not shown), so that the heating liquid is heated by the heater to have a predetermined temperature.

A first on-off valve 41 and a first flow control valve 42 are attached to the heating-liquid supply pipe 32. The first flow control valve 42 is located between the heat exchanger 11 and the first on-off valve 41. The first on-off valve 41 is a valve not having a flow rate regulating function, whereas the first flow control valve 42 is a valve having a flow rate regulating function.

The liquid supply system 30 further includes a cooling-liquid supply pipe 51 and a cooling-liquid discharge pipe 52, both coupled to the heat exchanger 11. The cooling-liquid supply pipe 51 is coupled to a cooling-liquid supply source (e.g. a cold water supply source) provided in a factory in which the polishing apparatus is installed. The cooling liquid is supplied to the heat exchanger 11 through the cooling-liquid supply pipe 51, flows in the heat exchanger 11, and is drained from the heat exchanger 11 through the cooling-liquid discharge pipe 52. In one embodiment, the cooling liquid that has flowed through the heat exchanger 11 may be returned to the cooling-liquid supply source through the cooling-liquid discharge pipe 52.

A second on-off valve 55 and a second flow control valve 56 are attached to the cooling-liquid supply pipe 51. The second flow control valve 56 is located between the heat exchanger 11 and the second on-off valve 55. The second on-off valve 55 is a valve not having a flow rate regulating function, whereas the second flow control valve 56 is a valve having a flow rate regulating function.

The pad-temperature regulating apparatus 5 further includes a pad-temperature measuring device 39 for measuring a surface temperature of the polishing pad 3 (which may hereinafter be referred to as pad surface temperature), and a controller 40 for operating the first flow control valve 42 and the second flow control valve 56 based on the pad surface temperature measured by the pad-temperature measuring device 39. The first on-off valve 41 and the second on-off valve 55 are usually open. A radiation thermometer, which can measure the surface temperature of the polishing pad 3 in a non-contact manner, can be used as the pad-temperature measuring device 39.

The pad-temperature measuring device 39 measures the surface temperature of the polishing pad 3 in a non-contact manner, and sends the measured value of the surface temperature to the controller 40. Based on the pad surface temperature measured, the controller 40 operates the first flow control valve 42 and the second flow control valve 56 to control the flow rates of the heating liquid and the cooling liquid so that the pad surface temperature is maintained at a preset target temperature. The first flow control valve 42 and the second flow control valve 56 operate according to control signals from the controller 40 and regulate the flow rates of the heating liquid and the cooling liquid to be supplied to the heat exchanger 11. Heat exchange occurs between the polishing pad 3 and the heating liquid and cooling liquid, flowing in the heat exchanger 11, whereby the pad surface temperature changes.

Such feedback control can maintain the surface temperature of the polishing pad 3 (i.e., the pad surface temperature) at a predetermined target temperature. A proportional integral derivative (PID) controller may be used as the controller 40. The target temperature of the polishing pad 3 is determined depending on the type of the wafer W or on the polishing process, and the determined target temperature is inputted into the controller 40 in advance.

In order to maintain the pad surface temperature at the predetermined target temperature, the heat exchanger 11 is moved to a temperature-regulating position, where the heat exchanger 11 can exchange heat with the polishing pad 3, during polishing of the wafer W. In this embodiment, the heat exchanger 11 lying in the temperature-regulating position is placed in contact with the surface (i.e. the polishing surface) of the polishing pad 3. In this specification, the manner of contact of the heat exchanger 11 with the surface of the polishing pad 3 includes not only direct contact of the heat exchanger 11 with the surface of the polishing pad 3, but also contact of the heat exchanger 11 with the surface of the polishing pad 3 in the presence of a polishing liquid (or slurry) between the heat exchanger 11 and the surface of the polishing pad 3. The temperature-regulating position of the heat exchanger 11 may be a position in which the heat exchanger 11 is separated from the polishing pad 3 as long as the heat exchanger can exchange heat with the polishing pad 3. In any case, heat exchange occurs between the polishing pad 3 and the heating liquid and cooling liquid, flowing in the heat exchanger 11, whereby the pad surface temperature is controlled.

Hot water may be used as the heating liquid to be supplied to the heat exchanger 11. When it is intended to raise the surface temperature of the polishing pad 3 more quickly, a silicone oil may be used as the heating liquid. Cold water or a silicone oil may be used as the cooling liquid to be supplied to the heat exchanger 11. In the case of using a silicone oil as the cooling liquid, the polishing pad 3 can be cooled quickly by coupling a chiller as a cooling-liquid supply source to the cooling-liquid supply pipe 51, and by cooling the silicone oil to a temperature of not more than 0° C. Pure water can be used as the cold water. In order to cool pure water to produce cold water, a chiller may be used as a cooling-liquid supply source. In this case, cold water that has flowed through the heat exchanger 11 may be returned to the chiller through the cooling-liquid discharge pipe 52.

The heating-liquid supply pipe 32 and the cooling-liquid supply pipe 51 are completely independent pipes. Thus, the heating liquid and the cooling liquid can be simultaneously supplied to the heat exchanger 11 without mixing with each other. The heating-liquid return pipe 33 and the cooling-liquid discharge pipe 52 are also completely independent pipes. Thus, the heating liquid is returned to the heating-liquid supply tank 31 without mixing with the cooling liquid, while the cooling liquid is either drained or returned to the cooling-liquid supply source without mixing with the heating liquid.

Figure 2:
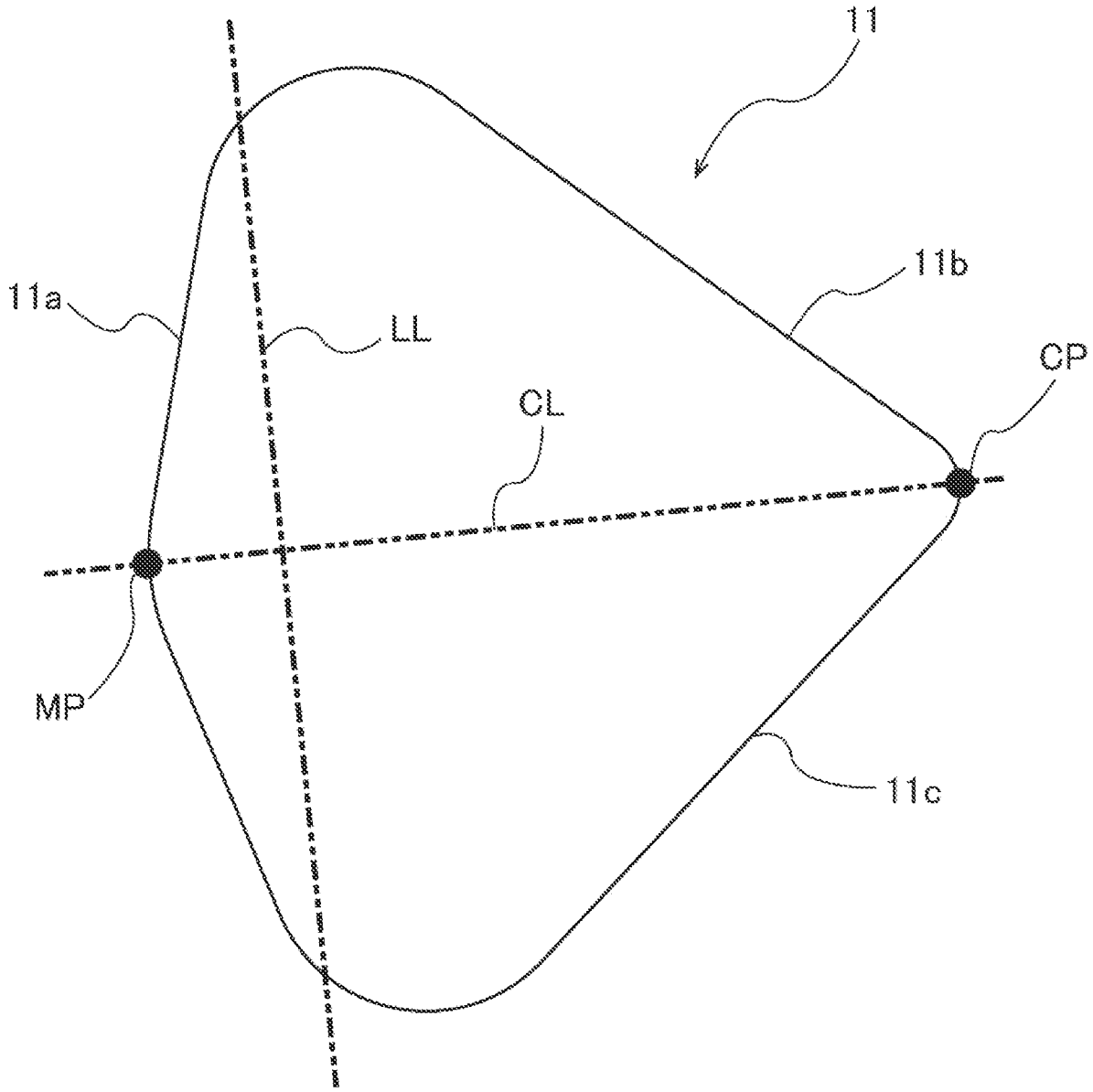
FIG. 2 is a schematic plan view showing the heat exchanger according to an embodiment.

Next, the heat exchanger 11 will be described with reference to FIGS. 2 through 4. FIG. 2 is a schematic plan view showing the heat exchanger according to an embodiment, FIG. 3 is a cross-sectional view showing an example of flow passages formed in the heat exchanger shown in FIG. 2, and FIG. 4 is a cross-sectional view showing another example of flow passages formed in the heat exchanger shown in FIG. 2.

As shown in FIG. 2, the heat exchanger 11 has an approximately triangular shape in planer view or in horizontal cross section. Specifically, the heat exchanger 11 has the approximately triangular shape having a long side 11*a* and short sides 11*b*, 11*c*, which has each vertex rounded. In this embodiment, the heat exchanger 11 has an approximately isosceles triangular shape in the horizontal cross section, which is linearly symmetrical about a line CL connecting an intersection point CP of the short sides 11*b*, 11*c*, and a midpoint MP of the long side 11*a*. Further, the heat exchanger 11 has a shape in which the midpoint MP of the long side 11*a* projects outward from a straight line LL connecting ends of the long side 11*a*. The straight line LL extends perpendicular to the straight line CL in the horizontal cross section of the heat exchanger 11. This shape of the heat exchanger 11 allows the cleaning of the heat exchanger 11 in a limited space, while allowing an area of a bottom of the heat exchanger 11 to be maximized.

Figure 3:
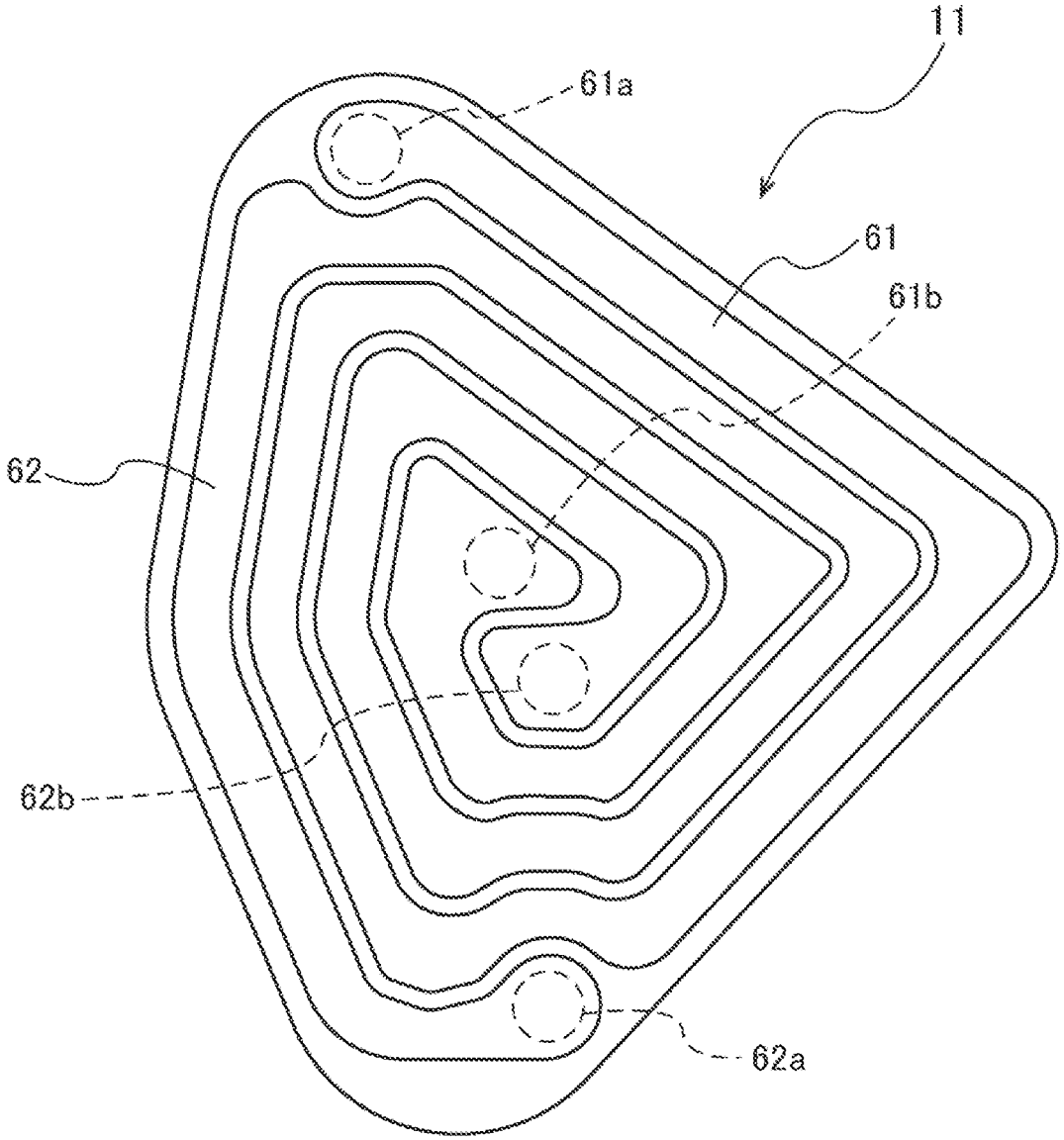
FIG. 3 is a cross-sectional view showing an example of flow passages formed in the heat exchanger shown in FIG. 2.
Figure 4:
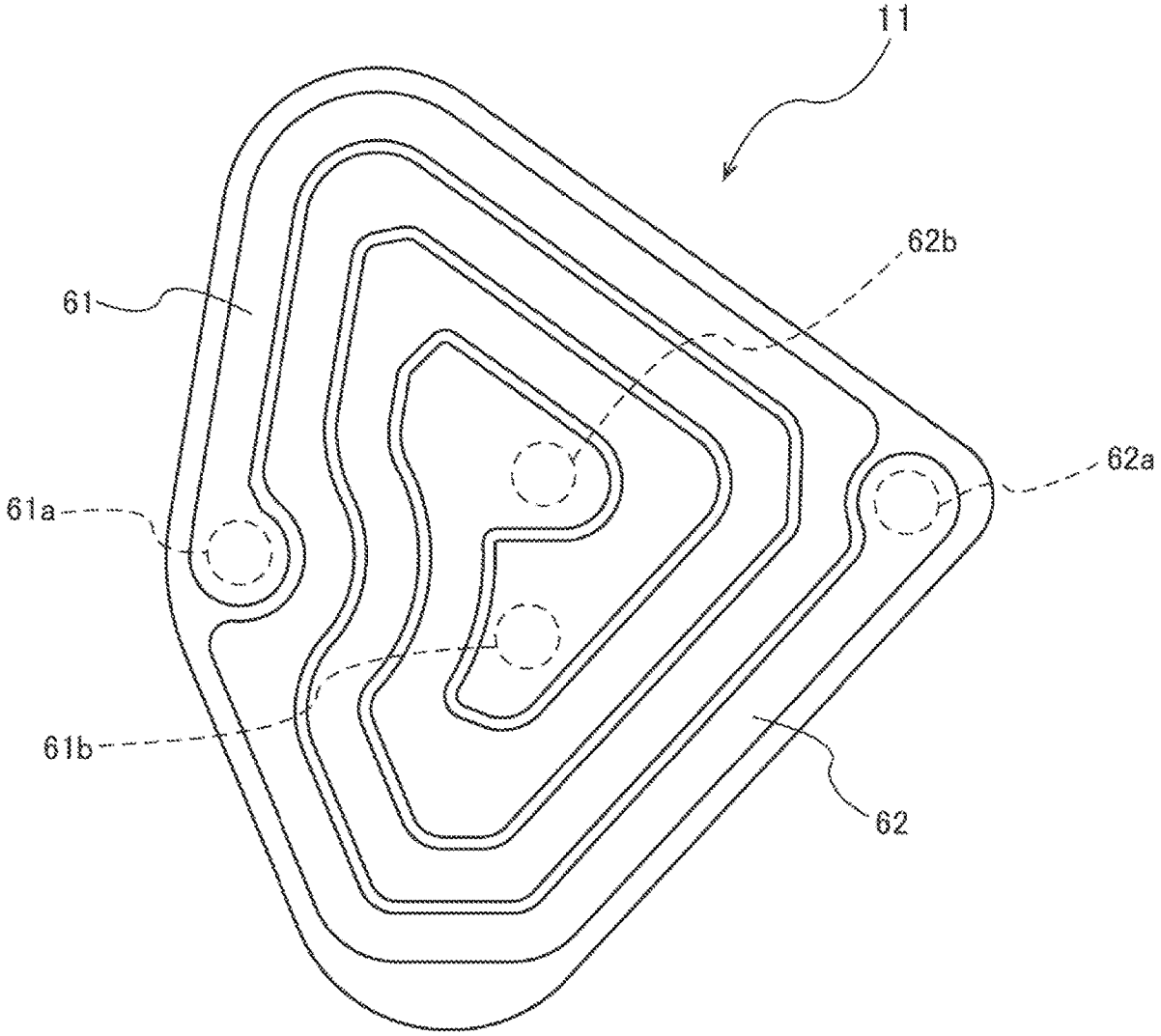
FIG. 4 is a cross-sectional view showing another example of flow passages formed in the heat exchanger shown in FIG. 2.

As shown in FIGS. 3 and 4, the heat exchanger 11 has a first flow passage 61 and a second flow passage 62 formed therein. The first flow passage 61 and the second flow passage 62 are arranged next to each other (or side by side), and extend in a spiral manner (in other words, in a swirl manner) along the approximately triangular outer shape of the heat exchanger 11.

The first flow passage 61 has two openings 61*a* and 61*b* formed respectively at both ends thereof, and the second channel 62 has two openings 62*a* and 62*b* formed respectively at both ends thereof. The heating-liquid supply pipe 32 is coupled to the opening 61*a* of the first flow passage 61, and the heating-liquid return pipe 33 is coupled to the opening 61*b* of the first flow passage 61. In other words, the first flow passage 61 serves as a heating-liquid flow passage, the opening 61*a* of the first flow passage 61 is an inlet of the heating-liquid flow passage, and the opening 61*b* of the first flow passage 61 is an outlet of the heating-liquid flow passage. The cooling-liquid supply pipe 52 is coupled to the opening 62*a* of the second flow passage 62, and the cooling-liquid return pipe 52 is coupled to the opening 62*b* of the second flow passage 62. In other words, the second flow passage 62 serves as a cooling-liquid flow passage, the opening 62*a* of the second flow passage 62 is an inlet of the cooling-liquid flow passage, and the opening 62*b* of the second flow passage 62 is an outlet of the cooling-liquid flow passage.

In one embodiment, the first flow passage 61 may serve as a cooling-liquid flow passage, and the second flow passage 62 may serve as a heating-liquid flow passage. In this case, the opening 61*a* of the first flow passage 61 is the inlet of the cooling liquid, the opening 61*b* is the outlet of the cooling liquid, the opening 62*a* of the second flow passage 62 is the inlet of the heating liquid, and the opening 62*b* is the outlet of the heating liquid.

The openings 61*a* and 62*a* are placed at a periphery of the heat exchanger 11, and the openings 61*a* and 62*a* are placed at the center of the heat exchanger 11. Therefore, the heating liquid and the cooling liquid flow in a spiral manner from the periphery to the center of the heat exchanger 11. The heating flow passage 61 and the cooling flow passage 62 are completely separated, so that the heating liquid and the cooling liquid are not mixed in the heat exchanger 11.

When the wafer W is polished in the polishing apparatus, dirt, such as abrasive grains contained in the polishing liquid, and polishing debris, adheres to the heat exchanger 11 in contact with the polishing pad 3. Therefore, the pad temperature regulating apparatus 5 has a cleaning apparatus for cleaning dirt attached to the heat exchanger 11. The cleaning apparatus includes a moving mechanism and a cleaning mechanism, which will be described later. The moving mechanism causes the heat exchanger 11 to move from a temperature-regulating position, where the heat exchanger 11 can exchange heat with the polishing pad 3 (i.e., where the heat exchanger 11 directly contacts or is close to the surface of the polishing pad 3), to a retreat position where the heat exchanger 11 is located on the side of the polishing pad 3. The cleaning mechanism serves as a mechanism for cleaning at least a bottom surface of the heat exchanger 11 moved to the retreat position.

Figure 5A:
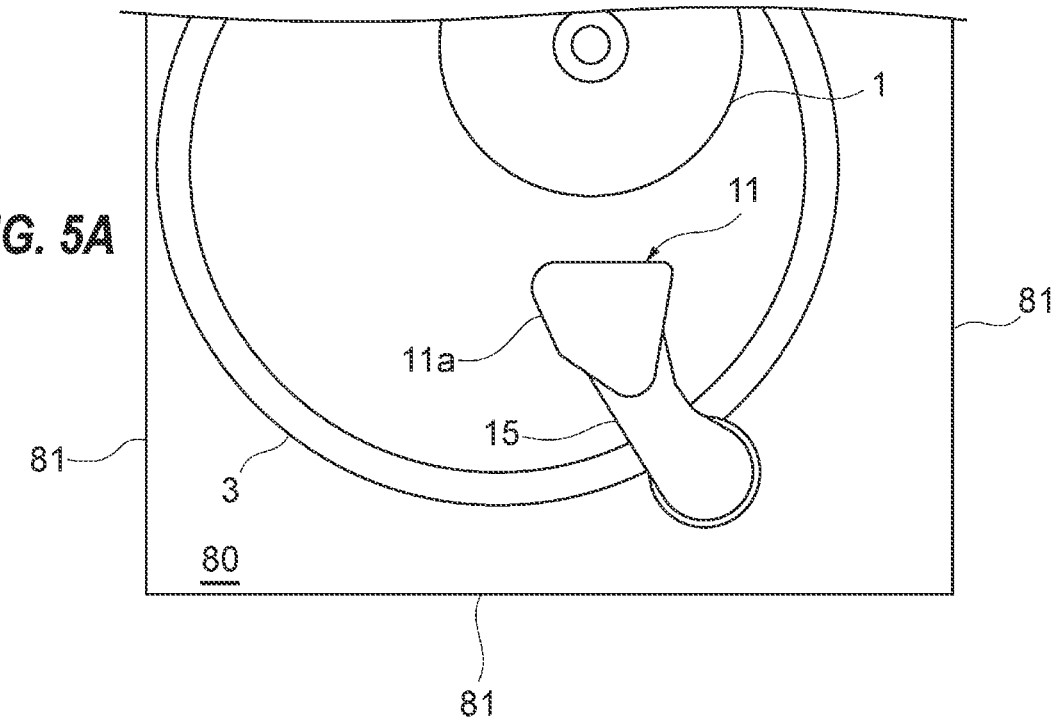
FIG. 5A is a schematic plan view showing a state in which the heat exchanger lies in the temperature regulating position.
Figure 5B:
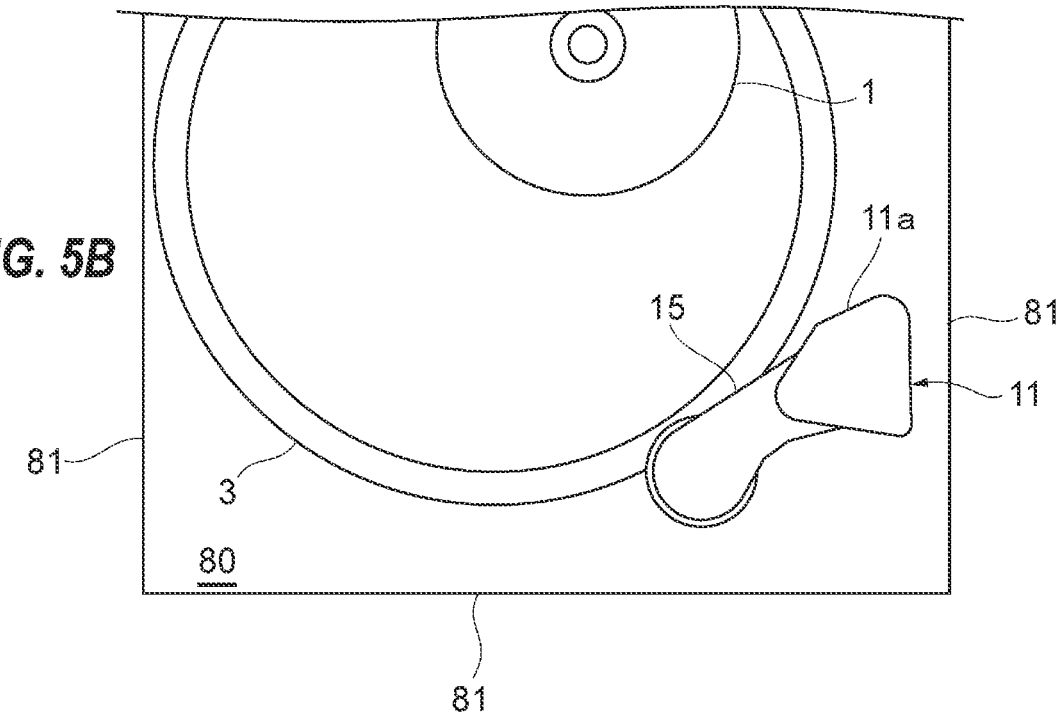
FIG. 5B is a schematic plan view showing a state in which the heat exchanger shown in FIG. 5A is moved to the retreat position.
Figure 6:
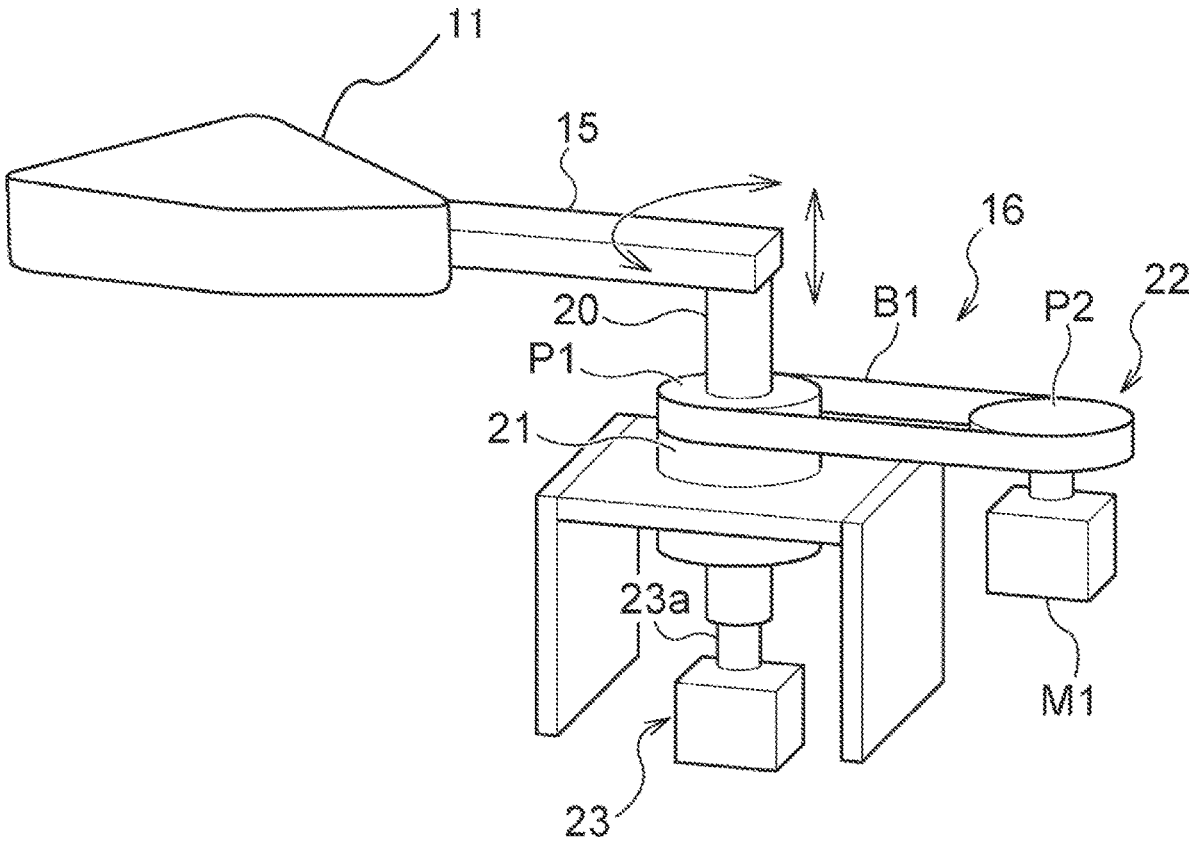
FIG. 6 is a perspective view schematically showing the heat exchanger coupled to a moving mechanism according to an embodiment.
Figure 7:
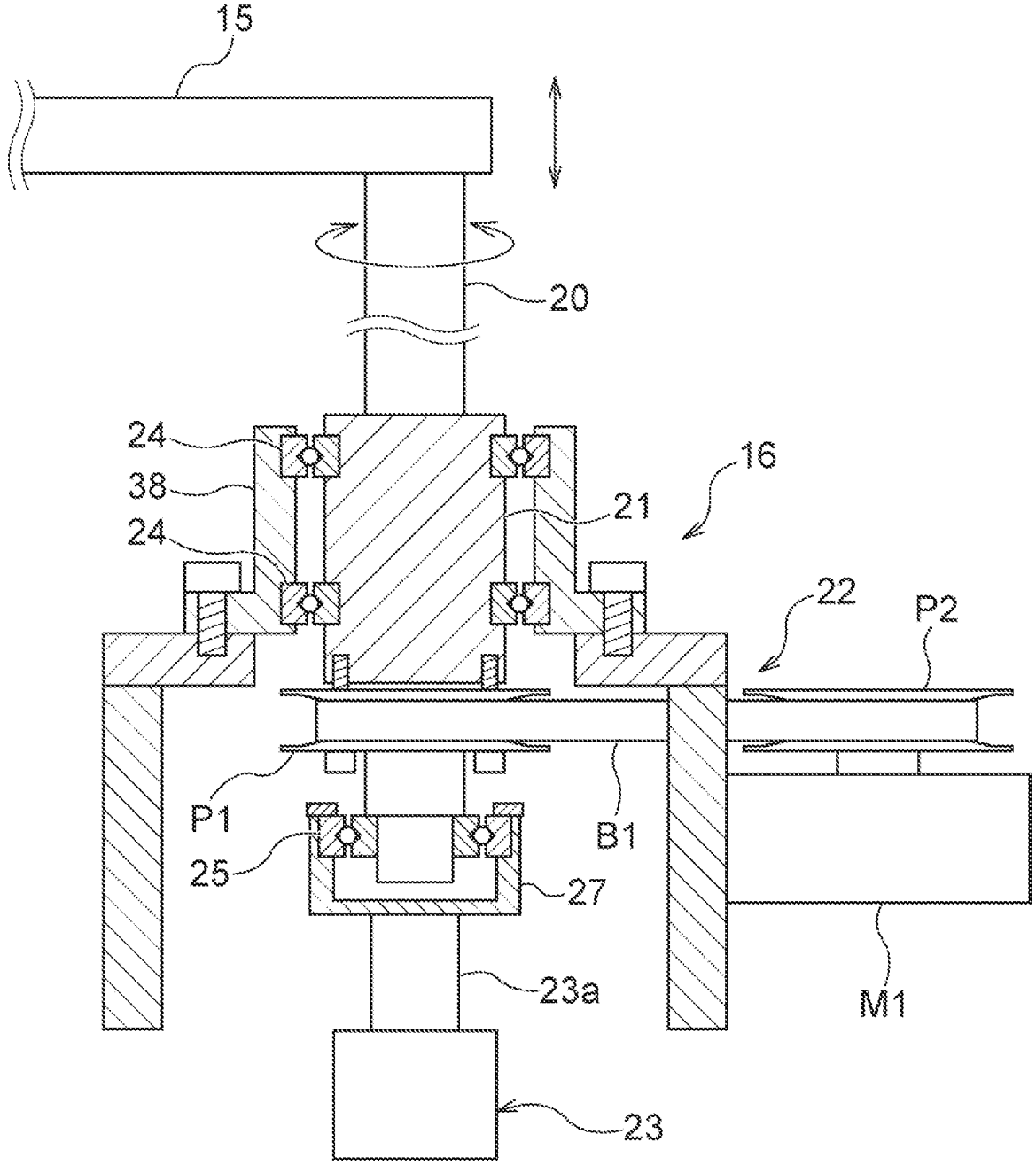
FIG. 7 is a schematic cross-sectional view of the moving mechanism shown in FIG. 6.

FIG. 5A is a schematic plan view showing a state in which the heat exchanger 11 lies in the temperature regulating position, FIG. 5B is a schematic plan view showing a state in which the heat exchanger 11 shown in FIG. 5A is moved to the retreat position. FIG. 6 is a perspective view schematically showing the heat exchanger 11 coupled to the moving mechanism according to an embodiment, and FIG. 7 is a schematic cross-sectional view of the moving mechanism shown in FIG. 6. As shown in FIG. 5B, the retreat position is located on the side of the polishing pad 3. When the polishing of the wafer W is finished, the heat exchanger 11 is moved to the retreat position by the moving mechanism 16 shown in FIGS. 6 and 7. The configuration of the moving mechanism is free-selected, as long as the heat exchanger can be moved between the temperature regulating position and the retreat position. Hereinafter, an example of the moving mechanism will be described with reference to FIGS. 6 and 7.

The moving mechanism 16 shown in FIG. 6 serves as a mechanism that causes the heat exchanger 11 to be moved upward with respect to the polishing pad 3 from a temperature-regulating position where the heat exchanger 11 contacts the surface of the polishing pad 3 and to be further rotated, thereby moving the heat exchanger to the retreat position. This moving mechanism 16 includes an arm 15 for holding the heat exchanger 11, a shaft 20 fixed to the arm 15, an elevating mechanism 23 for vertically moving the shaft 20, a pivoting mechanism 22 for rotating the shaft 20, and a ball spline bearing for supporting the shaft 20 so as to be vertically movable. As shown in FIG. 6, the heat exchanger 11 is coupled to one end of the arm 15. The elevating mechanism 23 is configured to vertically move the heat exchanger 11, which is coupled to the arm 15, through the shaft 20 and the arm 15. The shaft 20 shown in FIG. 6 is a spline shaft fixed to an end opposite to the end of the arm 15 to which the heat exchanger 11 is fixed.

In this embodiment, the elevating mechanism 23 is configured as a piston-cylinder mechanism. As shown in FIG. 7, a tip of the piston 23*a* of the elevating mechanism 23 is fixed to a lower end of a joint member 27. The joint member 27 has a recess formed therein, and a bearing 25 for rotatably supporting the lower end of the shaft 20 is disposed on a wall surface of the recess. To the elevating mechanism 23, a fluid (for example, compressed air, and nitrogen gas) used for moving the piston 23*a* up and down is supplied from a fluid supply source (not shown). When the fluid is supplied to the elevating mechanism 23, the piston 23*a* is raised whereby the shaft 20 is raised via the joint member 27 and the bearing 25. Since the shaft 20 is coupled to the arm 15, and the arm 15 is coupled to the heat exchanger 11, raising of the shaft 20 causes the arm 15 and the heat exchanger 11 to be raised with respect to the polishing pad 3. When the supply of the fluid to the elevating mechanism 23 is stopped, the piston 23*a* and the shaft 20 are lowered, whereby the arm and the heat exchanger 11 are lowered.

A main body of the ball spline bearing 21 is supported through a bearing 24 to a frame 38 fixed to the polishing apparatus. The pivoting mechanism 22 includes a motor M1, a first pulley P1 fixed to the shaft 20, a second pulley P2 fixed to a rotational shaft of the motor M1, and a belt B1 riding on these pulleys p1 and p2. When the motor M1 is set in motion, the second pulley P2 is rotated, the rotation of the second pulley P2 is transmitted to the first pulley P1 through the belt B1, and the first pulley P1 is rotated. A side surface of the first pulley P1 is coupled to the main body of the ball spline bearing 21, so that, when the first pulley P1 is rotated, the ball spline bearing 21 and the shaft 20 are pivoted, whereby the arm 15 and the heat exchanger 11 are pivoted with respect to the polishing pad 3. The rotational shaft of the motor M1 is rotated clockwise or counterclockwise, thereby enabling the heat exchanger 11 to be rotated about the shaft 20 so as to be approached to or separated from the polishing pad 3.

When moving the heat exchanger 11 from the temperature-regulating position to the retreat position, the elevating mechanism 23 of the moving mechanism 16 is firstly set in motion to move the heat exchanger 11 above the polishing pad 3. Next, the pivoting mechanism 22 is set in motion to pivot the heat exchanger 11 to the retreat position beside the polishing pad 3. As shown in FIG. 5B, when the heat exchanger 11 is moved to the retreat position, the longest side 11*a* of the heat exchanger 11 faces (an outer edge of) the polishing pad 3. As shown in FIG. 5A, when the heat exchanger 11 lies in the temperature regulating position, the longest side 11*a* of the heat exchanger 11 preferably extend in the radial direction of the polishing pad 3. With this configuration, the heat exchanger 11 can regulate the temperature of the surface of the polishing pad 3 over a wide area.

Figure 8A:
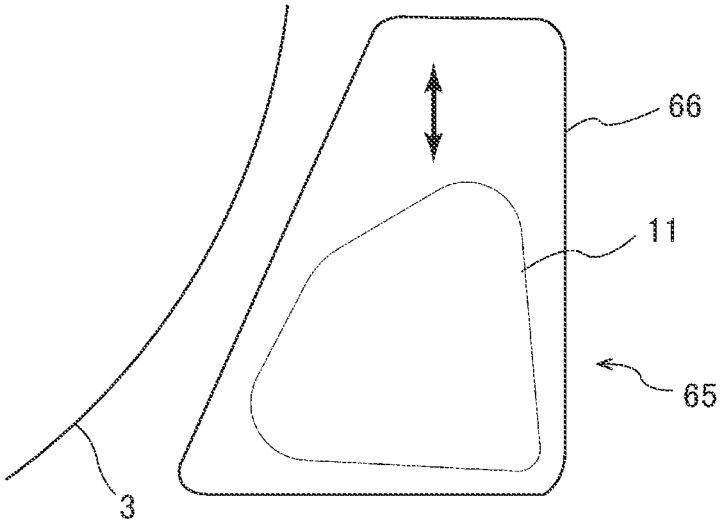
FIG. 8A is a schematic plan view of a cleaning tank of a cleaning mechanism for cleaning the heat exchanger moved to the retreat position.
Figure 8B:
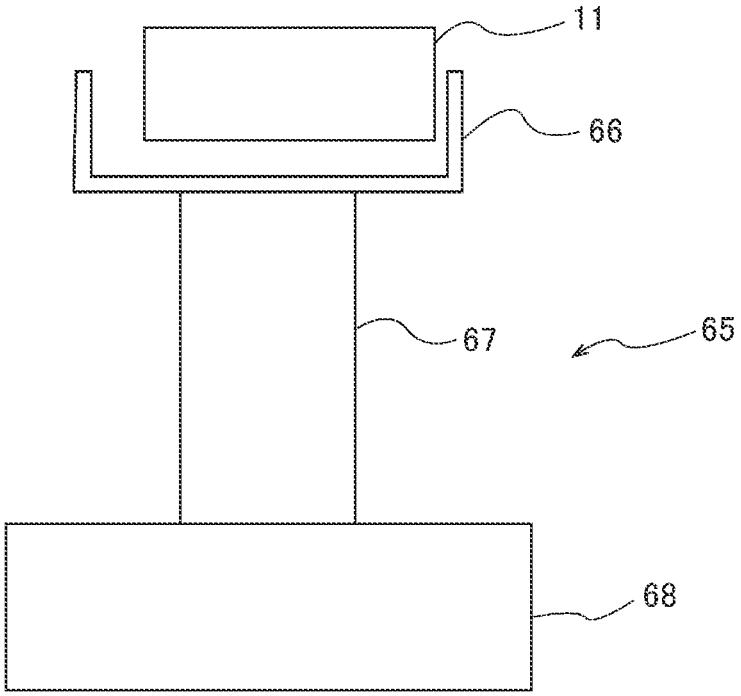
FIG. 8B is a schematic side view of the cleaning mechanism with the cleaning tank shown in FIG. 8A.

FIG. 8A is a schematic plan view of the cleaning tank of the cleaning mechanism for cleaning the heat exchanger 11 moved to the retreat position, and FIG. 8B is a schematic side view of the cleaning mechanism with the cleaning tank shown in FIG. 8A. The cleaning mechanism shown in FIGS. 8A and 8B includes a cleaning tank 66 into which a bottom surface of the heat exchanger 11 is immersed, an oscillating mechanism 68 that oscillates the cleaning tank 66 with respect to the heat exchanger 11 moved to the retreat position, and a coupling shaft 67 configured to couple the oscillating mechanism 68 to the cleaning tank 66.

The cleaning tank 66 has a bottomed cylindrical shape whose upper part is open. A cleaning-liquid supply line (not shown) is coupled to the cleaning tank 60, and a cleaning liquid is supplied to and stored in the cleaning tank 66 through the cleaning-liquid supply line. A cleaning liquid discharge line (not shown) is also coupled to the cleaning tank 66, and the cleaning liquid used for cleaning the heat exchanger 11 is discharged from the cleaning-liquid discharge line. The cleaning-liquid supply line is, for example, coupled to an opening formed in a side wall of the cleaning tank 66. The cleaning-liquid discharge line is, for example, coupled to an opening in a bottom wall of the cleaning tank 66.

Pure water can be used as the cleaning liquid, for example. In one embodiment, the cleaning liquid may be isopropyl alcohol (IPA), or a mixture of pure water and isopropyl alcohol. The cleaning liquid may contain a surfactant.

The oscillating mechanism 68 shown in FIG. 8B oscillates the cleaning tank 66 horizontally through the coupling shaft 67 (see two-headed arrow in FIG. 8A, for example). The configuration of the oscillating mechanism 68 is free-selected as long as the cleaning tank 66 can be oscillated with respect to the heat exchanger 11. Examples of the oscillating mechanism 68 include a combination of a servo motor and a gear mechanism (or a ball-screw mechanism), and an air cylinder. When the oscillating mechanism 68 oscillates the cleaning tank 66 through the coupling shaft 67, the cleaning liquid stored in the cleaning tank 66 can be shaken, thereby efficiently cleaning the heat exchanger 11.

As shown in FIGS. 5A and 5B, the polishing head 1, the polishing pad 3, and the heat exchanger 11 of the pad-temperature regulating apparatus 5 are placed in the polishing chamber 80, which is divided by a plurality of partition walls 81. As each partition wall 81 is brought closer to the polishing pad 3 in order to achieve downsizing of the polishing apparatus, a shape of vacant space formed between the polishing pad 3, which has a circular shape in horizontal cross-sectional view, and each partition wall 81 approaches a triangular shape in horizontal cross-sectional view. In this embodiment, in this vacant space, the cleaning tank 66 is provided, and thus a shape of the heat exchanger 11 is made into a triangle in horizontal cross-sectional view to maximize an area of the bottom surface (i.e., the surface in contact with the polishing pad 3) of the heat exchanger 11.

Figure 15A:
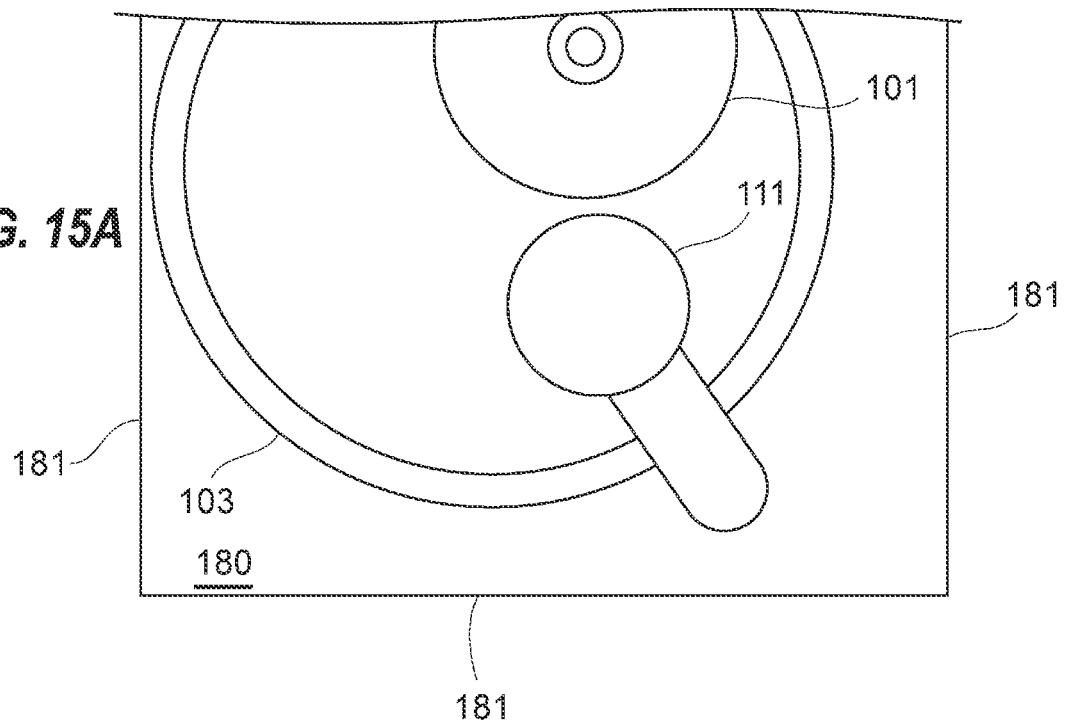
FIG. 15A is a schematic top view showing an example of a conventional polishing apparatus.
Figure 15B:
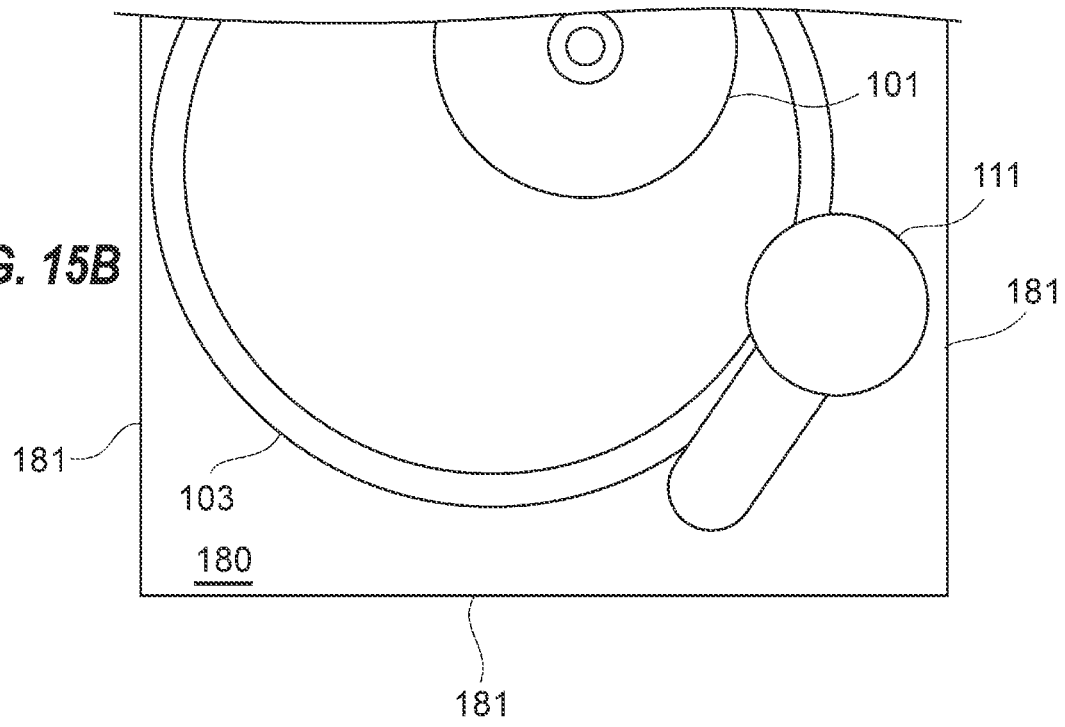
FIG. 15B is a schematic top view showing a state where a heat exchanger shown in FIG. 15A is moved toward a partition wall.

The bottom surface of the heat exchanger 11 (having the approximate triangular shape) according to this embodiment has an area approximately half that of the bottom surface of the conventional heat exchanger 111 (having a circular shape) shown in FIGS. 15A and 15B. However, by experiments performed by the present inventors, it has found that a polishing rate of the wafer W when the temperature of the polishing pad is regulated using the heat exchanger 11 according to this embodiment is almost the same as a polishing rate of the wafer W when the temperature of the polishing pad is regulated using the conventional heat exchanger 111.

In these experiments, a polishing rate of the wafer W (reference polishing rate) was first measured under the condition that the temperature of the polishing pad was not regulated by the heat exchanger 11 and the heat exchanger 111. Next, the polishing rates were measured when the heat exchanger 11 according to this embodiment and the conventional heat exchanger 111 were maintained at the same temperature (e.g., 80° C.) and the wafers W were polished respectively.

When the temperature of the polishing pad was regulated using the conventional heat exchanger 111, the polishing rate of the wafer W was increased by 15% compared to the reference polishing rate. In contrast, the polishing rate of the wafer W when the temperature of the polishing pad was regulated using the heat exchanger 11 according to this embodiment was increased by 13.7% compared to the reference polishing rate. It has found from these experimental results that the polishing rate of the wafer W when the temperature of the polishing pad was regulated using the heat exchanger 11 according to this embodiment was almost the same, although slightly lower than the polishing rate of the wafer W when the temperature of the polishing pad was regulated using the conventional heat exchanger 111.

Thus, according to this embodiment, since the heat exchanger 11 has the approximate triangular shape in horizontal cross-sectional view, the heat exchanger 11 can be cleaned in the vacant space formed between the polishing pad 3 and the partition walls 81 that divide the polishing chamber 80. In other words, the heat exchanger 11 can be cleaned in the cleaning tank 66 provided in the limited space having the triangular shape.

When the polishing pad 3 is rotated, undulation may occur on the surface (i.e., the polishing surface) of the polishing pad 3. Further, in some cases, the polishing of the wafer W may be performed in a condition where the heat exchanger 11 is slightly separated from the polishing pad 3 by penetrating the polishing liquid (slurry) between the heat exchanger 11 and the surface of the polishing pad 3. Accordingly, the heat exchanger 11 is preferably coupled to the arm 15 by a coupling mechanism that allows the heat exchanger 11 to move with respect to the arm 15 to the extent that the heat exchanger 11 can follow the undulation of the polishing surface, and to the extent that the heat exchanger 11 can be separated from the polishing pad 3 by a buoyancy of the polishing liquid. On the other hand, if the direction of movement of the heat exchanger 11 relative to the arm 15 is allowed to be unrestricted, the heat exchanger 11 move freely in the cleaning tank 66 due to the cleaning liquid shaking in the cleaning tank 66, and as a result, there is a risk that parts of the coupling mechanism are significantly worn out.

Therefore, the movement mechanism 16 of the pad-temperature regulating apparatus 5 has a link mechanism that allows vertical movement of the heat exchanger 11 relative to the arm 15, but restricts horizontal movement of the heat exchanger 11 relative to the arm 15. The heat exchanger 11 is coupled to the arm 15 through this link mechanism. In the following, an example of such link mechanism will be explained with reference to FIGS. 9 through 14. However, the configuration of the link mechanism is free-selected as long as it allows vertical movement of the heat exchanger 11 relative to the arm 15 but restricts horizontal movement of the heat exchanger 11 relative to the arm 15, and thus is not limited to this example.

Figure 9:
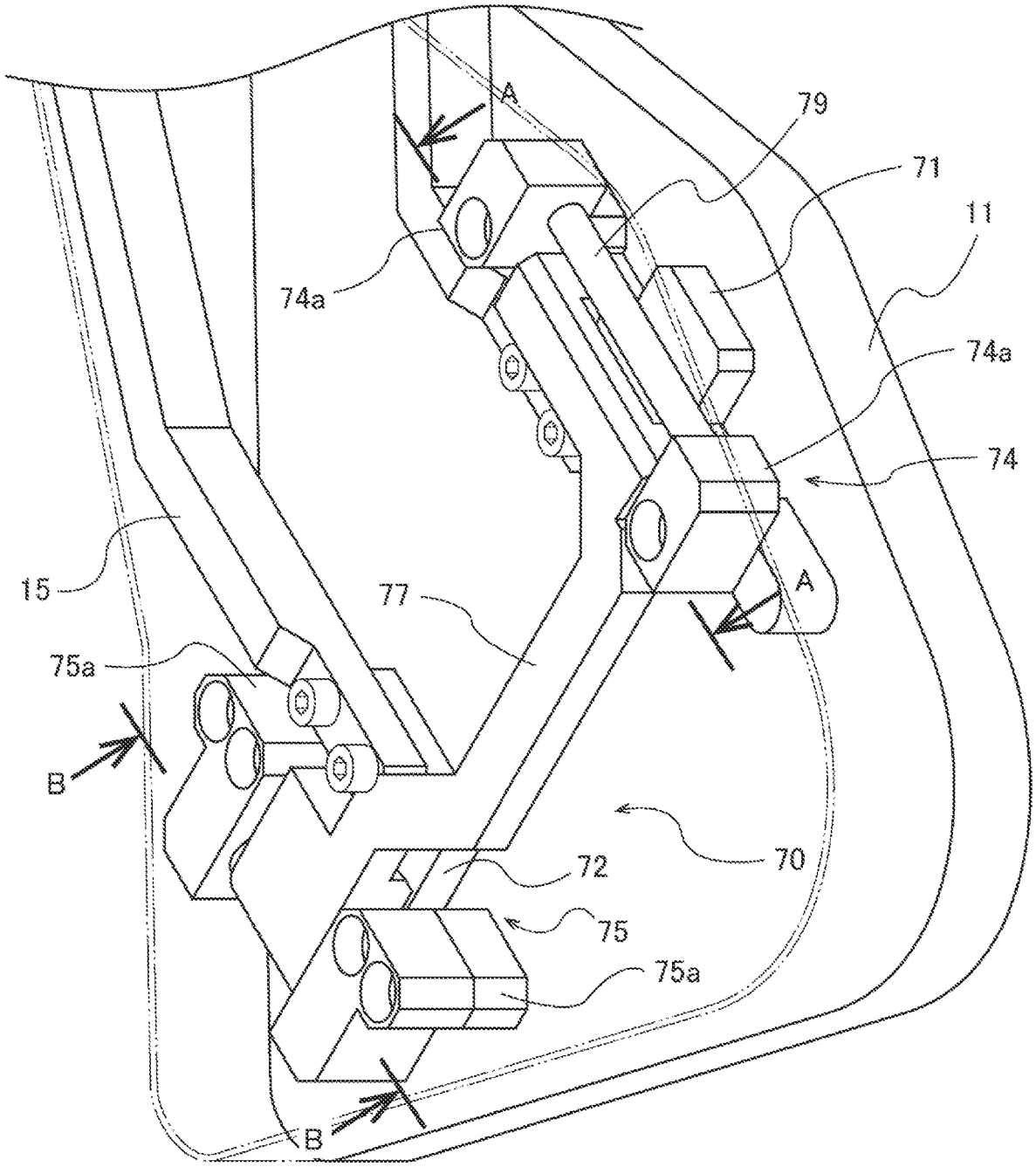
FIG. 9 is a schematic view showing a link mechanism according to an embodiment.
Figure 10:
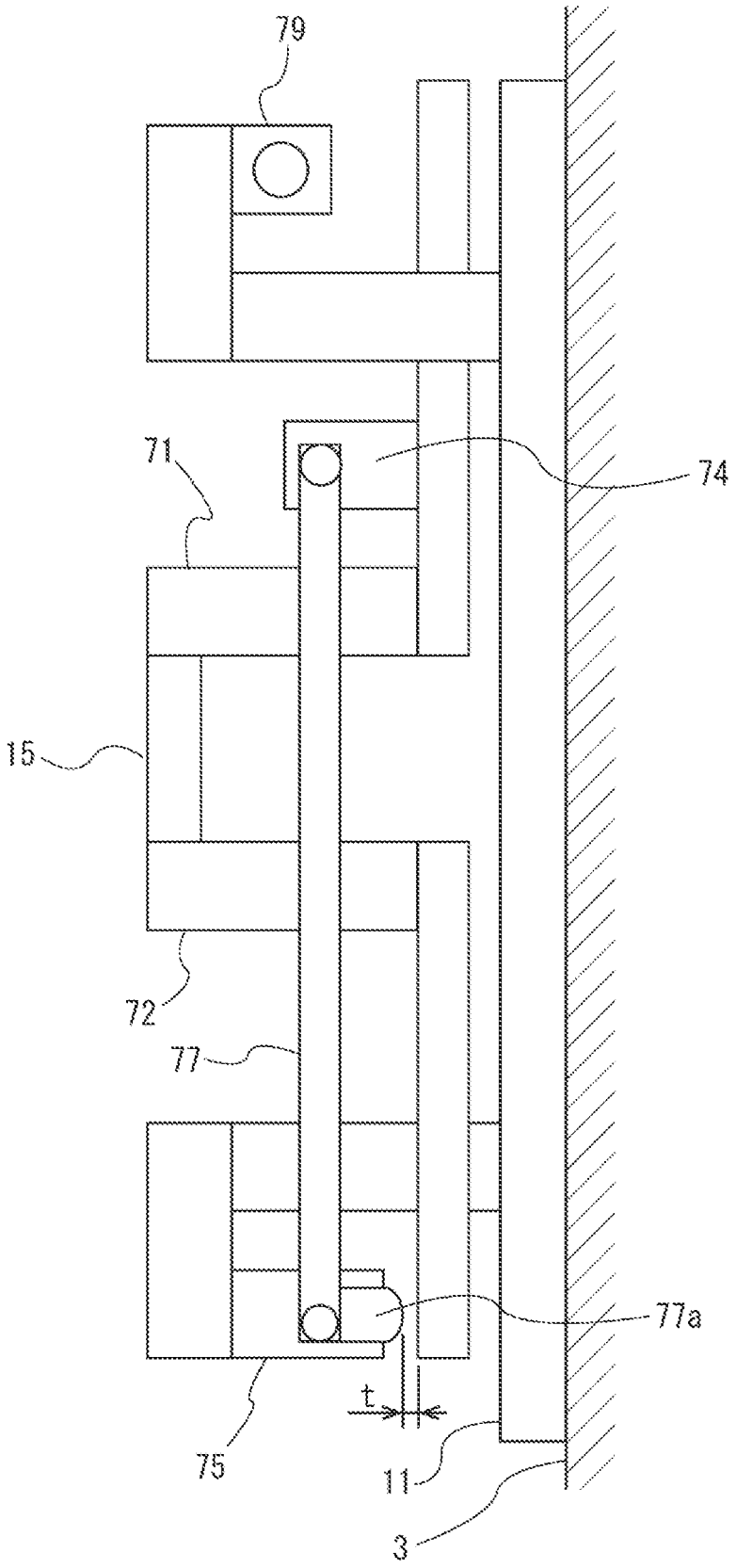
FIG. 10 is a simplified view of the link mechanism shown in FIG. 9.

FIG. 9 is a schematic view showing a link mechanism according to an embodiment. FIG. 10 is a simplified view of the link mechanism shown in FIG. 9. FIG. 10 corresponds to a view that illustrates the construction of the link mechanism shown in FIG. 9 by use of blocks in order to facilitate the understanding of the invention. Further, FIG. 10 illustrates a state of the link mechanism 70 when the heat exchanger 11 is in the temperature regulating position (i.e., in contact with the surface of the polishing pad 3).

The link mechanism 70 shown in FIGS. 9 and 10 includes a first link arm 71 coupled to one side of the arm 15, a second link arm 72 coupled to the other side of the arm 15, a first link block 74 attached to an upper surface of the first link arm 71, and a second link block 74 attached to an upper surface of the heat exchanger 11. The second link arm 72 is disposed on the opposite side of the first link arm 71 across the arm 15. The link mechanism 70 further has a link rod 77 that is rotatably supported by the first link block 74 and the second link block 75. The first link block 74 and the second link block 75 support the ends of the link rod 77, respectively. At an end of the link rod 77 supported by the second link block 75, a link projection 77*a*, which extends downward, is formed. The link projection 77*a* faces an upper surface of the second link arm 72. Further, the link mechanism 70 has a stopper 79, which is located above the first link arm 71, and faces an upper surface of the first link arm 71.

Figure 11:
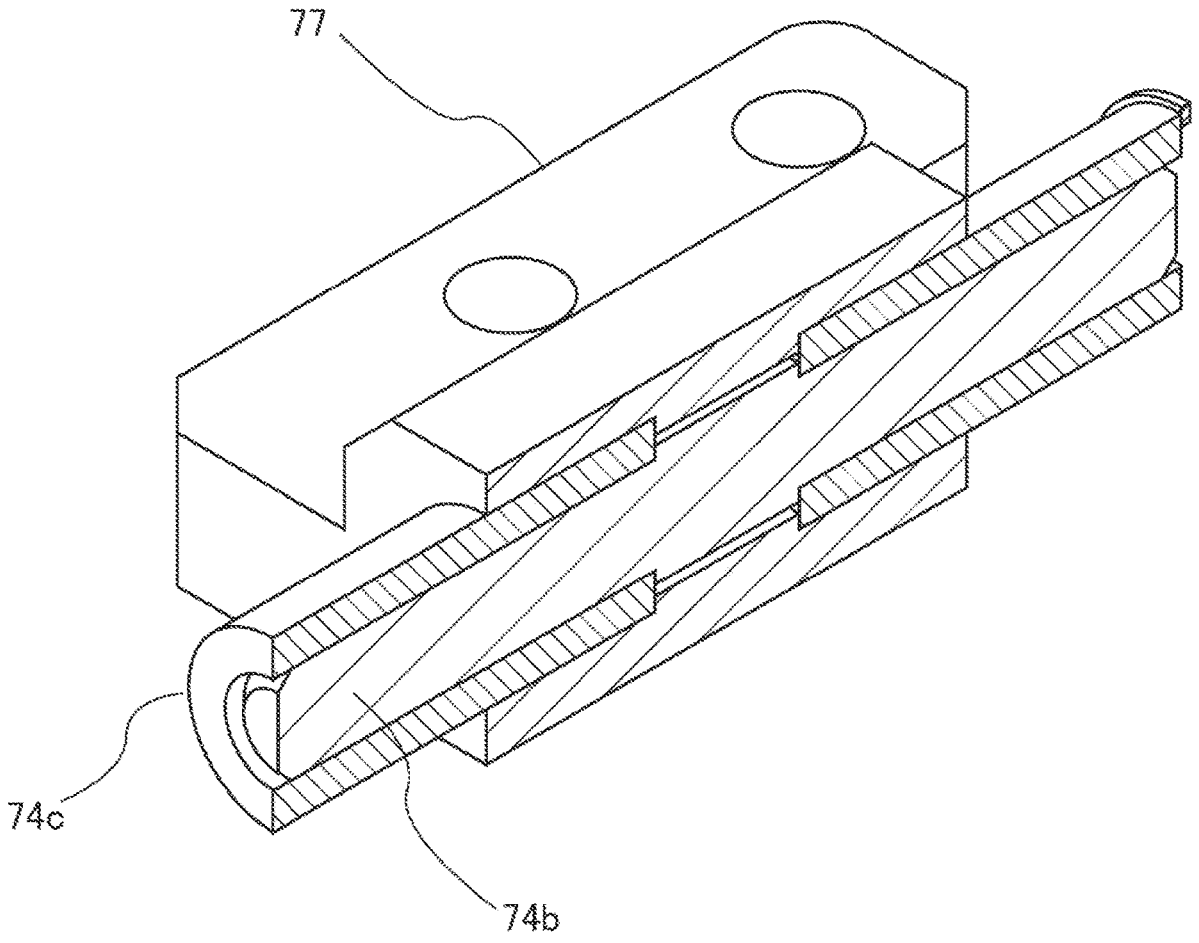
FIG. 11 is a cross-sectional view taken along line A-A in FIG. 9.

FIG. 11 is a cross-sectional view taken along line A-A in FIG. 9. As shown in FIGS. 9 and 11, the first link block 74 has two column members 74*a*, 74*a*, a shaft 74*b* coupled to these column members 74*a*, 74*a*, and a resin cover 74*c* covering an outer circumference of the shaft 74*b*. The link rod 77 has a first through-hole into which the shaft 74*b* and the resin cover 74*c* are inserted, and is supported by the first link block 74 so as to be able to rotate around the shaft 74*b*. A diameter of the first through-hole is approximately equal to an outer diameter of the resin cover 74*c*. Therefore, movement of the link rod 77 is restricted except for rotation around the shaft 74*b* of the first link block 74.

Figure 12:
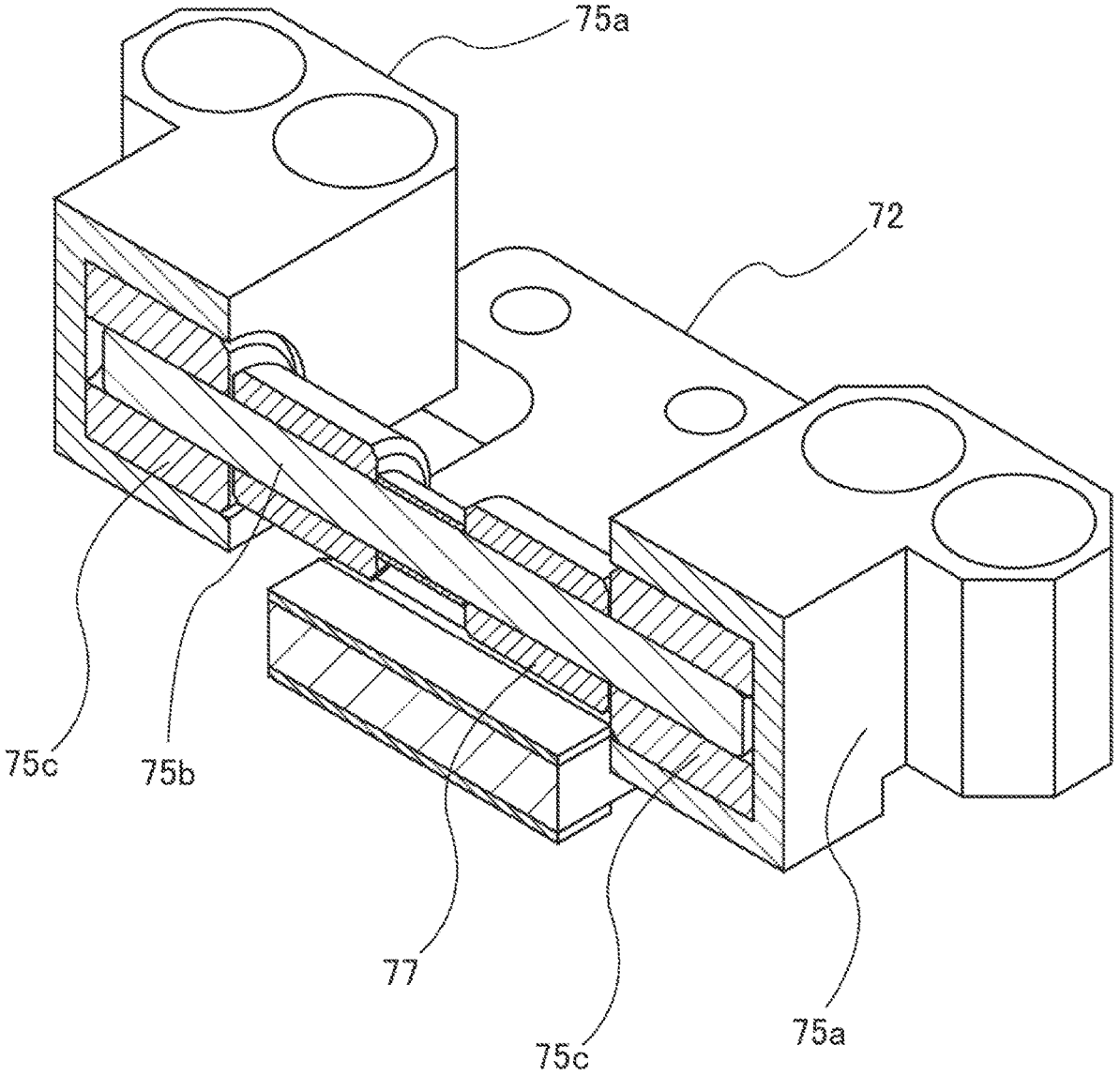
FIG. 12 is a cross-sectional view taken along line B-B in FIG. 9.

FIG. 12 is a cross-sectional view taken along line B-B in FIG. 9. As shown in FIGS. 9 and 12, the second link block 75 has two column members 75*a*, 75*a*, a shaft 75*b* coupled to these column members 75*a*, 75*a*, and a resin cover 75*c* covering an outer circumference of the shaft 75*b*. The link rod 77 has a second through-hole into which the shaft 75*b* and resin cover 75*c* are inserted, and is supported by the second link block 75 so as to be able to rotate around the shaft 75*b*. A diameter of the second through-hole is approximately equal to an outer diameter of the resin cover 75*c*. Therefore, movement of the link rod 77 is restricted except for rotation around the shaft 75*b* of the second link block 75.

Figure 13:
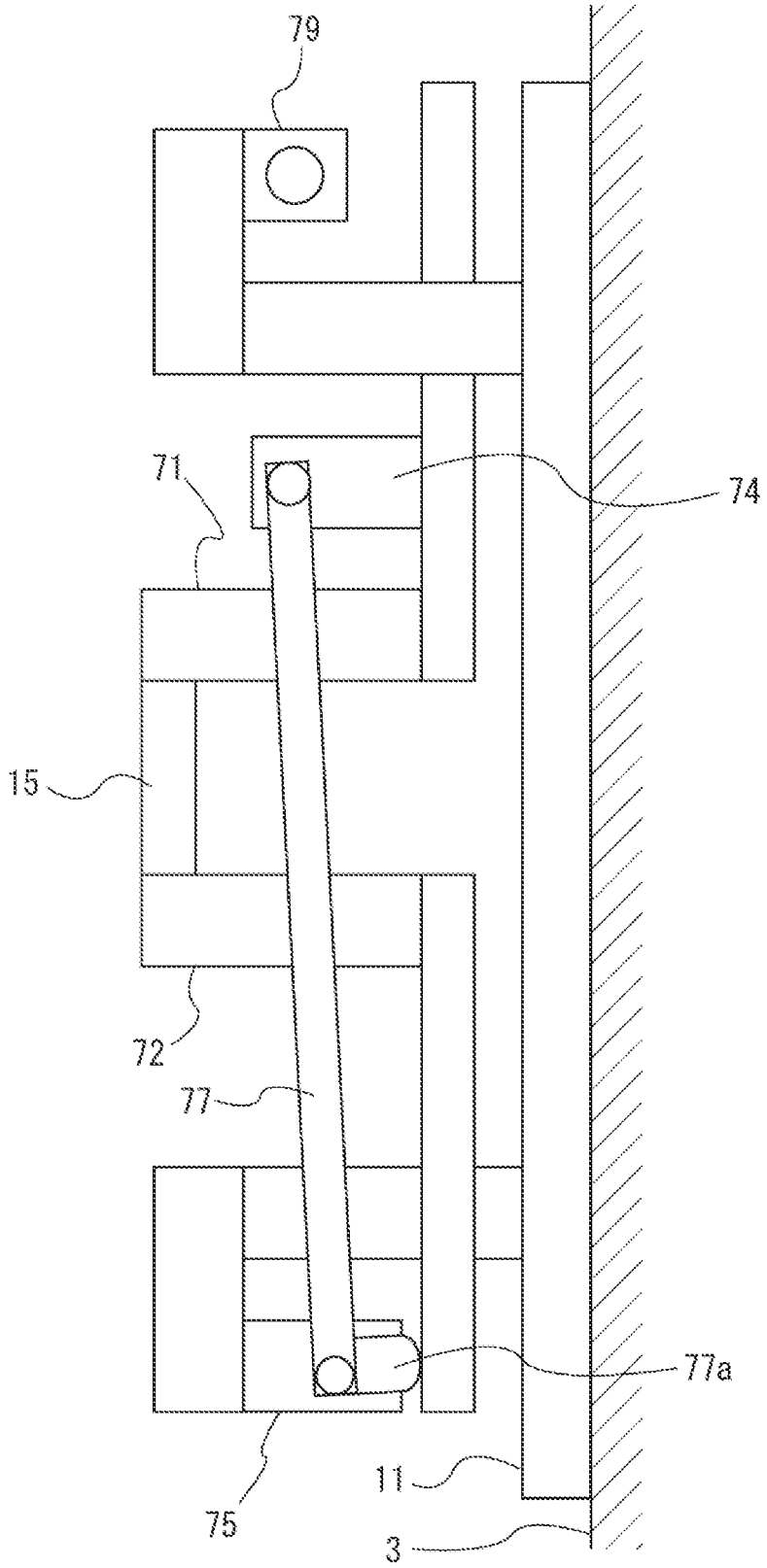
FIG. 13 is a schematic view showing a state of operation of the link mechanism shown in FIG. 9.
Figure 14:
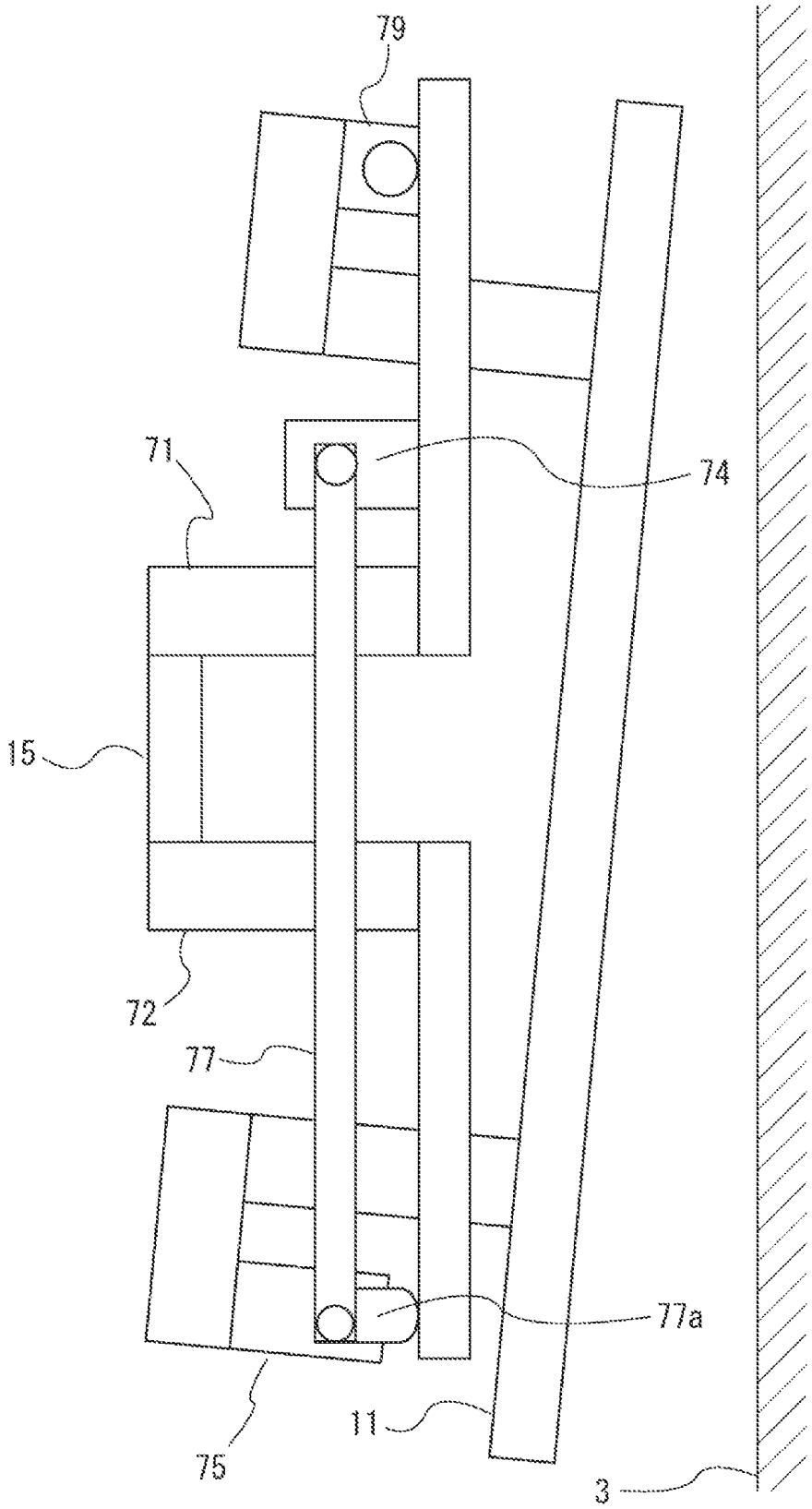
FIG. 14 is a schematic view showing a state of operation of the link mechanism shown in FIG. 9.

Next, with reference to FIG. 10, and FIGS. 13 through 15, operation of the link mechanism 70 with such configuration will be described below. FIGS. 13 through 15 are simplified views each showing operation of the link mechanism, and as in FIG. 10, the configuration of the link mechanism 70 is illustrated by use of blocks.

As shown in FIG. 10, when the heat exchanger 11 is in the temperature regulating position, the link projection 77*a* of the link rod 77 is separated from the second link arm 72. More specifically, a gap t is formed between the link projection 77*a* and the second link arm 72. As described above with reference to FIGS. 11 and 12, for the link rods 77 of the link mechanism 70, only rotation with respect to the first link block 74 and the second link block 75 is allowed. Therefore, movement of the heat exchanger 11 relative to the arm 15 in the vertical direction is allowed through the link mechanism 70 only for a magnitude of this gap t. The gap t is set so that the heat exchanger 11 can follow the undulation of the polishing surface, and the heat exchanger 11 can be separated from the polishing pad 3 by the buoyancy of the polishing liquid. The magnitude of the gap t is, for example, several millimeters.

Next, when, in order to move the heat exchanger 11 to the retreat position, the elevating mechanism 23 (see FIG. 6) raises the arm 15 and the heat exchanger 11, the upper surface of the second link arm 72 is placed in contact with the projection 77*a* of the link rod 77 (see FIG. 13). When, after the link protrusion 77*a* of the second link arm 72 contacts the upper surface of the second link arm 72, the elevating mechanism 23 further raises the arm 15 and the heat exchanger 11, the second link block 75 rotates with respect to one end of the link rod 77 and the first link block 74 rotates with respect to the other end of the link rod 77, so that the heat exchanger 11 is separated from the surface of the polishing pad 3 in a state where the heat exchanger 11 is at an angle to the arm 15. The rotational movements of the first link block 74 and the second link block 75 with respect to the link rod 77 are prevented by contacting the upper surface of the first link arm 71 to the stopper 79 (FIG. 14).

In this state, the heat exchanger 11 is moved to the cleaning tank 66 of the cleaning mechanism 65 by the moving mechanism 16, and is cleaned by the cleaning mechanism 65 (see FIGS. 8A and 8B). As described above, during the cleaning of the heat exchanger 11, the cleaning tank 66 is oscillated in the horizontal direction by the oscillating mechanism 68. However, the heat exchanger 11 is prevented from moving in the horizontal direction by the link mechanism 70, so that the heat exchanger 11 cannot move horizontally due to an action of the cleaning liquid moving in the cleaning tank 66. As a result, the vertical movement of the heat exchanger 11 relative to the arm 15 is allowed, while preventing the parts of the link mechanism 70 for coupling the heat exchanger 11 to the arm 15 from being significantly worn out.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A pad-temperature regulating apparatus for regulating a surface temperature of a polishing pad, comprising:

a heat exchanger configured to contact the polishing pad to exchange heat with the polishing pad;

a moving mechanism configured to move the heat exchanger between a temperature regulating position where the heat exchanger can exchange heat with the polishing pad, and a retreat position located on a side of the polishing pad; and a cleaning mechanism configured to clean the heat exchanger moved to the retreat position, wherein the heat exchanger has an approximate triangular shape in a horizontal cross-section, and a longest side of the heat exchanger faces the polishing pad when the heat exchanger is moved to the retreat position, wherein the moving mechanism includes:

an arm configured to hold the heat exchanger;

an elevating mechanism configured to vertically move the heat exchanger through the arm; and a link mechanism which is attached to the heat exchanger, and is configured to couple the heat exchanger to the arm, and wherein the link mechanism allows vertical movement of the heat exchanger relative to the arm, while restricting horizontal movement of the heat exchanger relative to the arm, and wherein the link mechanism includes:

a first link arm which is coupled to the arm;

a second link arm which is coupled to the arm, and is disposed on opposite side of the first link arm across the arm;

a first link block attached to an upper surface of the first link arm, a second link block attached to an upper surface of the heat exchanger, and a link rod whose both ends are rotatably supported by the first link block and the second link block, and which has a link projection extending downward, and formed at an end supported by the second link block.

2. The pad-temperature regulating apparatus according to claim 1, wherein the heat exchanger has a heating flow passage and a cooling flow passage into which a heating liquid having a regulated temperature and a cooling liquid having a regulated temperature are supplied respectively, the heating flow passage and the cooling flow passage are arranged next to each other, and extend in a spiral manner along an outer shape of the heat exchanger, an inlet of the heating flow passage and an inlet of the cooling flow passage are placed at a periphery of the heat exchanger, and an outlet of the heating flow passage and an outlet of the cooling flow passage are placed at a center of the heat exchanger.

3. The pad-temperature regulating apparatus according to claim 1, wherein the heat exchanger has an approximately isosceles triangular shape in the horizontal cross section, which is linearly symmetrical about a line connecting a midpoint of a longest side and an intersection point of the remaining short sides.

4. The pad-temperature regulating apparatus according to claim 3, wherein the heat exchanger has a shape in which a midpoint of the longest side projects outward from a straight line connecting both ends of the long side.

5. The pad-temperature regulating apparatus according to claim 1, wherein the link projection is separated from the upper surface of the second link arm when the heat exchanger is in the temperature regulating position, and the link projection, when the heat exchanger is raised by the elevating mechanism, comes into contact with the upper surface of the second link arm.

6. The pad-temperature regulating apparatus according to claim 5, wherein the link mechanism further includes a stopper which prevents vertical movement of the heat exchanger with respect to the arm, and the stopper is placed in contact with the upper surface of the first link arm when, after the link projection contacts the upper surface of the second link arm, the heat exchange is further raised by the elevating mechanism.

7. The pad-temperature regulating apparatus according to claim 1, wherein the cleaning mechanism includes:

a cleaning tank into which a bottom surface of the heat exchanger is immersed; and an oscillating mechanism for oscillating the cleaning tank with respect to the heat exchanger.

8. A polishing apparatus in which a substrate is brought into sliding contact with a polishing pad to thereby polish the substrate, comprising:

a polishing table for supporting the polishing pad;

a polishing head configured to press the substrate against the polishing pad; and a pad-temperature regulating apparatus configured to regulate a surface temperature of the polishing pad;

wherein the pad-temperature regulating apparatus comprises the pad-temperature regulating apparatus according to claim 1.

* * * * *